US008070923B2

(12) United States Patent
Peragine et al.

(10) Patent No.: US 8,070,923 B2
(45) Date of Patent: Dec. 6, 2011

(54) STRUCTURE FOR CATHODIC FINGERS OF CHLOR-ALKALI DIAPHRAGM CELLS

(75) Inventors: Salvatore Peragine, Sesto S. Giovanni (IT); Luciano Iacopetti, Milan (IT)

(73) Assignee: Industrie de Nora S.p.A., Milan (IT)

( * ) Notice: Subject to any disclaimer, the term of this patent is extended or adjusted under 35 U.S.C. 154(b) by 2296 days.

(21) Appl. No.: 10/519,691

(22) PCT Filed: Jul. 11, 2003

(86) PCT No.: PCT/EP03/07542

§ 371 (c)(1),
(2), (4) Date: Dec. 27, 2004

(87) PCT Pub. No.: WO2004/007803

PCT Pub. Date: Jan. 22, 2004

(65) Prior Publication Data

US 2005/0236269 A1 Oct. 27, 2005

(30) Foreign Application Priority Data

Jul. 12, 2002 (IT) ..... MI2002A1538

(51) Int. Cl.
*C25B 9/00* (2006.01)

(52) U.S. Cl. ..... 204/282; 204/284

(58) Field of Classification Search ..... 204/282, 204/284

See application file for complete search history.

(56) References Cited

U.S. PATENT DOCUMENTS

| | | | | |
|---|---|---|---|---|
| 3,910,827 | A | 10/1975 | Raetzsch et al. | |
| 4,628,596 | A * | 12/1986 | Currey et al. | 29/825 |
| 4,670,123 | A * | 6/1987 | Pimlott et al. | 204/279 |
| 6,214,181 | B1 * | 4/2001 | Iacopetti et al. | 204/256 |

FOREIGN PATENT DOCUMENTS

| | | |
|---|---|---|
| DE | 23 53 583 | 5/1974 |
| WO | WO 98/55670 | 12/1998 |
| WO | WO 00/06798 | 2/2000 |

* cited by examiner

*Primary Examiner* — Arun S Phasge
(74) *Attorney, Agent, or Firm* — Charles A. Muserlian

(57) ABSTRACT

A structure of cathodic fingers for a chlor-alkali diaphragm cell with improved voltage and faradic efficiency is described, characterized in that a sheet provided with projections is inserted inside each finger. The interwoven wire mesh or the perforated sheet, forming each finger, is secured by a conductive connection, preferably by welding, to the top of each projection, thereby providing optimal uniformity of the electrical current distribution. The projections have a shape preferably equivalent to spherical caps, disposed in a quincuncial pattern. The internal volume of each finger is subdivided by the sheet provided with projections into two portions wherein both the free upward motion of hydrogen bubbles and the free longitudinal motion of the separated hydrogen take place towards the cell perimetrical chamber. Within the internal volume of each finger, which is only partially occupied by the projections, the natural recirculation of the solution constituted by the product caustic soda and the depleted sodium chloride also occurs, supported by the hydrogen bubbles.

20 Claims, 6 Drawing Sheets

STRUCTURE FOR CATHODIC FINGERS OF CHLOR-ALKALI DIAPHRAGM CELLS

This application is a 371 of PCT/2003/007542 filed Jul. 11, 2003.

The production of chlorine by electrolysis of solutions of alkali halides, particularly of sodium chloride solutions, is nowadays the electrochemical process by far of greatest industrial relevance: it can be carried out by means of three different technologies, namely membrane, diaphragm and mercury cathode electrolysis.

The first technology, which is the most advanced and most recently established, is characterised by lower energy consumption resulting from lower cell voltage and reduced use of steam required for caustic soda concentration. The two other techniques are negatively affected to a large extent by the substantially greater energy consumption due to the higher cell voltage and, in the case of diaphragm cells, to the considerable amount of steam required for concentrating caustic soda up to the commercial value of 50% by weight. However, despite the obvious advantage, the membrane technology is still characterised by a lower than expected market penetration, having only been used up to now for the construction of few new plants and the replacement of diaphragm and mercury cathode plants already obsolete and of hard maintenance. This situation is practically due to the fact that the existing diaphragm and mercury cathode plants have essentially no capital costs, since all of them were built in the seventies and eighties, later experiencing continuous improvements, which have essentially solved the problems of environmental pollution associated with the release of asbestos fibres and mercury, meanwhile improving their energetic consumption and thereby reducing their gap versus the membrane technology.

In the specific case of diaphragm plants, the diaphragms consisting of asbestos fibres bonded with perfluorinated polymers were overcome by the diaphragms consisting of perfluorinated polymer fibres hydrophilised by means of various additives, for example fibres or particles of zirconium oxide. Furthermore, the conventional expandable anodes made of titanium activated by platinum group metal oxides were substantially improved thanks to a so-called zero gap version, provided with devices capable of exerting an elastic pressure and bringing the anode movable surface in direct and extended contact with the diaphragm as described in U.S. Pat. No. 5,534,122; moreover said anodes have been equipped with double expanders, in other words connections allowing the passage of electric current from the movable surfaces of the anodes to the current distributing bars, with appreciable ohmic drop reduction, as illustrated in U.S. Pat. No. 5,993,620. Furthermore, the anodes can be advantageously provided with devices allowing a significant increase of the internal recirculation of brine with a consequent advantage in terms of lower voltage and decreased oxygen evolution, two factors both allowing to reduce the energy consumption per ton of produced chlorine: this latter improvement is described in U.S. Pat. No. 5,066,378. Finally, the replacement of the rubber linings used to protect the copper bases whereon the anodes are fixed with titanium sheets, and the use of new types of elastic seals between cathode body and anode supporting base and between each anode and its supporting base as indicated in WO 01/34878 have allowed to considerably extend the operating lifetime of the individual cells which constitute an electrolysis plant: this resulted in a further reduction of maintenance costs and a greater production capacity with unchanged cell design.

A very clear description of the operation of the chlor-alkali diaphragm cells is given in Ullmann's Encyclopedia of Chemical Technology, 5$^{a}$ Ed., Vol. A6, pp. 424-437, VCH, while details of the internal structure of these cells are exhaustively illustrated in the figures of U.S. Pat. No. 5,066,378.

As it can be noticed, the several proposals made in the years to improve the operation of the diaphragm cells are essentially directed to finding more or less drastic modifications of diaphragms and anodes with the relevant way of their fixing to the supporting base, whereas substantially poor attention was devoted to the cathodes, both as concerns the cathode body with the relevant electrical connections and the structure of the active cathodic surface whereon the hydrogen evolution reaction and the formation of caustic soda take place. In particular, the latter element, namely the active cathodic area, consists of a conductive surface provided with holes, such as a mesh of interwoven wires or a perforated sheet both made of conductive material, generally carbon steel, shaped as to form prism-like structures with rather flattened rectangular section fixed by welding to a perimetrical chamber, equally consisting of interwoven wires or of a perforated sheet, connected to the side walls of the cathodic body and provided with at least one nozzle on the bottom to provide an outlet for the solution containing the product caustic soda and the depleted sodium chloride, and with at least one nozzle on the top for the hydrogen discharge. On these structures, known to the experts in the field as "fingers", the diaphragm is deposited by means of vacuum suction from an aqueous suspension containing the polymer fibres and particles which, as previously mentioned, constitute the diaphragm itself. In the diaphragm cell structure, the diaphragm-coated fingers are intercalated with the anodes and the surface thereof can either be in contact with that of the diaphragms or spaced therefrom by few millimeters. In both cases the fingers shall not undergo any flexure that would cause abrasions on the diaphragm with consequent deterioration thereof. Moreover, during operation the current must be transmitted as uniformly as possible to the entire surface of the fingers: a non uniform distribution would involve an increase in the cell voltage and a decrease in the efficiency of caustic soda generation with simultaneous higher oxygen content in chlorine. As a consequence, for the best result, the fingers must be provided with adequate stiffness and at the same time with high electric conduction.

According to U.S. Pat. No. 4,138,295 granted to Diamond Shamrock Technologies SA, Switzerland and to the more recent patent application WO 00/06798 filed by Eltech Systems Corp., USA, the fingers are provided with a longitudinally corrugated internal sheet made of carbon steel or copper: the mesh of interwoven wires or the perforated sheet is fixed, preferably by welding, to the vertices of the corrugations well solving the problems of the homogeneous current distribution and of the stiffness. However the corrugations, developed as mentioned in the longitudinal direction, do not allow the hydrogen bubbles to rise freely in the vertical direction, to subsequently gather along the upper generatrix of the fingers and enter therefrom the perimetrical chamber equipped as said with at least one outlet for the gases. The longitudinally corrugated sheet forces hydrogen to gather below each of the corrugations and to flow longitudinally along each corrugation until exiting through appropriate openings into the perimetrical chamber: since this flow can hardly be equalised, the amount of hydrogen present under each corrugation is variable and occludes to a different extent the corresponding facing zone of the diaphragm. Hence, it can be concluded that the longitudinally corrugated internal sheet causes an inevitable unbalance of the electric current distribution. This unbalance, in its turn, leads to an inhomogeneous concentration of the caustic soda with a negative impact on both the faradic efficiency and the oxygen content in chlorine.

Also U.S. Pat. No. 4,049,495 granted to O. De Nora Impianti Elettrochimici S.p.A, Italy, describes the use of corrugated internal sheets, but with vertically arranged corrugations: in this case it is obvious that hydrogen can freely gather in the upper portion of the fingers, but its flow towards the perimetrical chamber is hindered by the upper portion of the corrugations. Furthermore, for a given electric current distribution, the stiffening effect of the vertical corrugations may be unsatisfactory.

U.S. Pat. Nos. 3,988,220 and 3,910,827, both granted to PPG Industries Inc., USA, disclose designs for the element inside the fingers similar to those just considered, respectively horizontal strips of perforated sheet and longitudinal conductive bars provided with vertical strips of sheet welded thereto. Though undoubtedly ensuring an appropriate stiffness, the latter solution entails the problem of the difficult hydrogen release discussed in the case of U.S. Pat. No. 4,049,495. The design of U.S. Pat. No. 3,988,220, on the contrary, represents a satisfactory answer to the requirements of stiffness, homogeneous current distribution and free hydrogen discharge, but only by means of a complex structure, difficult to be made and therefore unacceptably expensive. Moreover the structure of U.S. Pat. No. 3,988,220 does not allow the upward movement of hydrogen bubbles to create an appropriate recirculation of the product caustic soda inside the fingers: as a consequence of this missed recirculation, pockets of caustic soda at higher concentration may be present, particularly in case of anomalies in the electric current distribution and of diaphragm porosity, with negative impacts on the faradic efficiency and the oxygen content in chlorine.

It is therefore an object of the present invention to provide a novel finger structure particularly suitable for chlor-alkali diaphragm electrolysis cells, characterised by substantial stiffness and uniformity of electric current distribution, and capable of overcoming the drawbacks of the structures of the prior art.

Under a first aspect the present invention consists of a finger structure for chlor-alkali diaphragm cells provided with high conductivity and capable of ensuring a substantial homogeneity of electric current distribution on the whole surface of the fingers.

Under a second aspect the structure of the present invention is characterised by the necessary stiffness to prevent flexures capable of inducing abrasions against the anodes of said chlor-alkali diaphragm cells and possibly of damaging the diaphragm deposited on said fingers.

Under a third aspect the structure of the present invention allows the free upward motion of the hydrogen bubbles and the free flow of hydrogen, separated along the upper generatrix of the fingers, in the longitudinal direction towards the perimetrical chamber of the cells.

Under a further aspect the structure of the present invention facilitates the internal natural recirculation of caustic soda, induced by the upward motion of the hydrogen bubbles, ensuring a substantially uniform concentration inside the fingers.

These and other consequent advantages will be made clearer by the following detailed description of the invention.

The present invention consists of a novel structure for fingers of diaphragm electrolytic cells, particularly useful for chlor-alkali diaphragm cells.

In a preferred embodiment, the novel finger structure comprises a hollow portion defining an internal volume in fluid communication with a perimetrical chamber, the hollow portion housing a current distributing reinforcing element comprising a sheet or multiplicity of sheets provided with projections.

The invention will be described making reference to chlor-alkali diaphragm electrolysis cells for the sake of simplicity, but it is understood that the structure of the present invention can be applied to all diaphragm cells equipped with fingers; the structure of the invention allows to simultaneously achieve:

a) a uniform distribution of electric current on the whole surface of the fingers and therefore of the diaphragm deposited thereon,
b) an appropriate stiffness such as to prevent flexures capable of causing rubbing between fingers and anodes, which in said cells are intercalated to the fingers, with possible damage to the diaphragm due to abrasion,
c) a free ascensional movement of the hydrogen bubbles generated on the surface of the mesh or perforated sheet made of conductive material constituting the fingers with equally free longitudinal flow of hydrogen towards the perimetrical chamber of said cells,
d) an optimal recirculation inside the fingers of the caustic soda formed simultaneously with hydrogen on the surface of said meshes or perforated sheets with consequent homogenisation of the concentration even in case of local inhomogeneity of the diaphragm porosity and anomalies in the electric current distribution.

This set of advantages is achieved according to a particularly preferred embodiment of the invention using at least one current distributing reinforcement sheet longitudinally inserted inside each finger, wherein said sheet is provided with projections on both sides.

BRIEF DESCRIPTION OF THE DRAWINGS

As shown in FIGS. 1 and 2, where a portion of sheet (1) according to the invention and two cross sections are respectively illustrated, the projections are preferably arranged according to a quincuncial pattern and are similar to spherical caps obtained by plastic deformation of the original flat sheet 1. The projections (2) protruding towards the observer are indicated by a continuous line, whereas the projections (3) protruding towards the opposite side are indicated by a dotted line. FIG. 2 shows the two cross sections of FIG. 1 according to the X-X and Y-Y lines: in both cases, the thickness of sheet in section is identified by hatching.

Although the realisation of the projections by plastic processing, for example by deformation of the sheet using a suitable tool in an appropriate press, is the particularly preferred manufacturing process, manufacturing methods based on welding or brazing of projections, separately obtained, onto the flat sheet can also be used, and it is understood that the structures thus obtained fall within the scope of the present invention. However it is clear to the experts of the field that these methods require a labour commitment which makes them intrinsically slow and definitely more expensive than the method of plastic processing.

Figure 1:
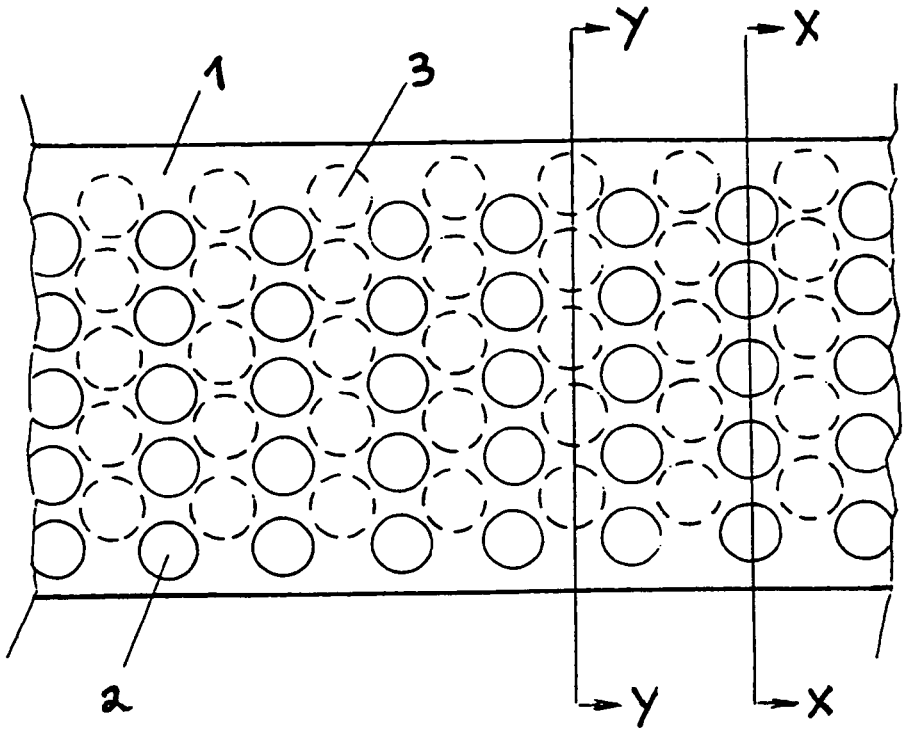
FIG. 1 is an illustration of the current distributing reinforcement sheet of the electrode finger and FIG. 2 is a cross-sections thereof.
Figure 2:
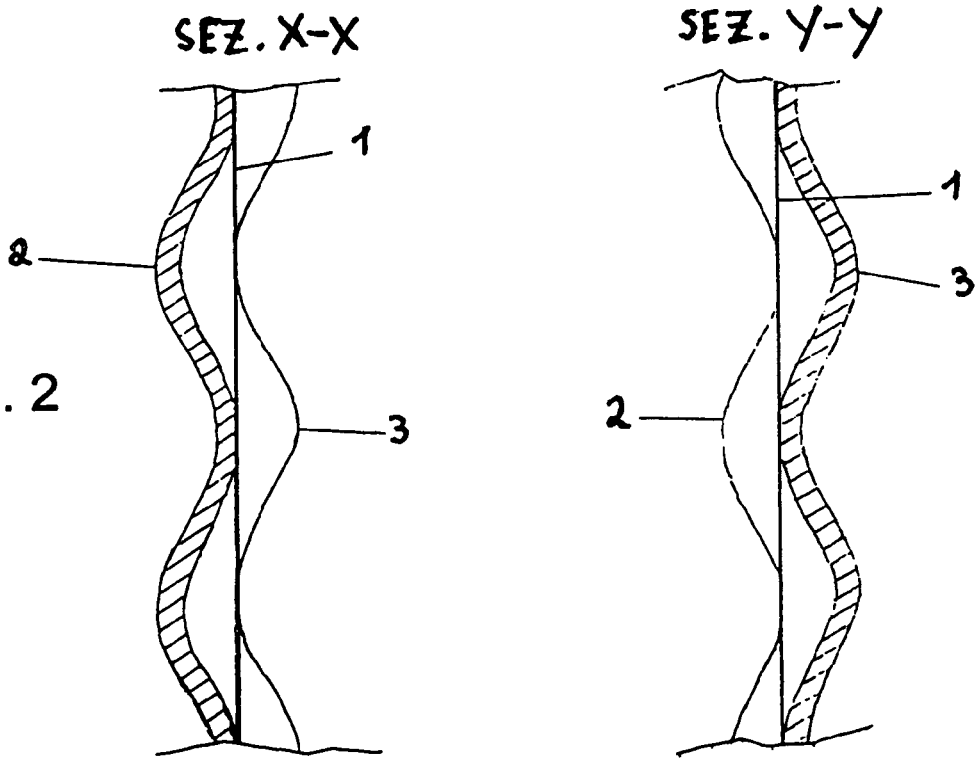
Figure 3:
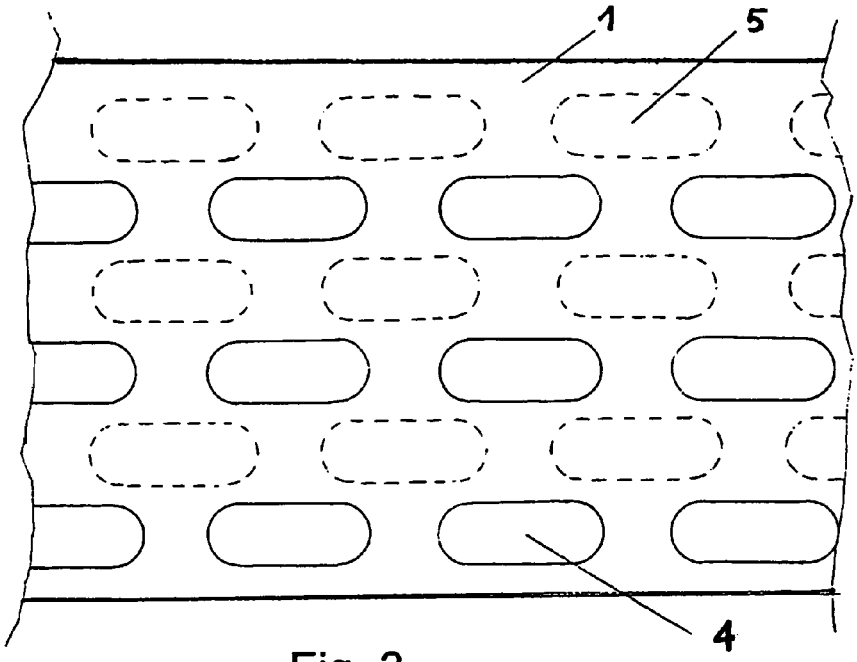
FIG. 3 shows the projections that are illustrated as elliptic caps.
Figure 4:
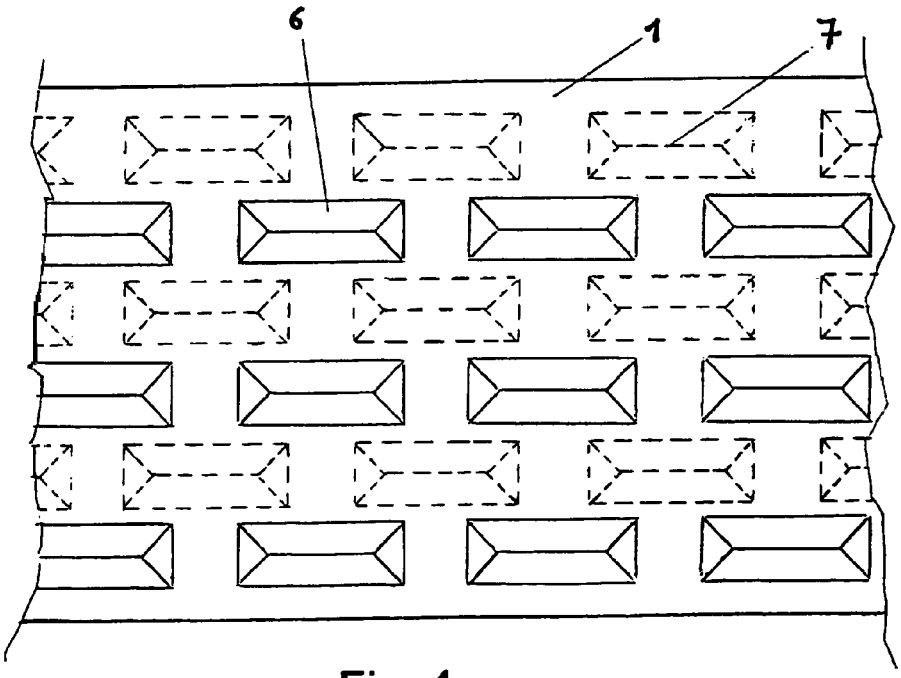
FIG. 4 illustrates the prismatic sections.

Although in FIGS. 1 and 2 the projections are equivalent to spherical caps, different shapes are also possible, for example elliptic caps, as indicated in FIG. 3, or prismatic sections as indicated in FIG. 4: in these figures the projections protruding towards the observer ((4) and (6) respectively) are again indicated by continuous lines, whereas those protruding towards the opposite directions ((5) and (7) respectively) are identified by dotted lines. Other shapes are further conceivable even if those allowing production by plastic deformation of the original flat sheets are preferred, as this process can be easily automated with a far reduced manpower.

A particularly preferred aspect of the present invention is the arrangement of the projections according to a quincuncial pattern or the like, wherein no completely flat vertical portions of sheet are present: as made clear by FIG. 1, each vertical section of the sheet affects at least a portion of some projections, which therefore effectively cooperate to provide a high stiffness, defined as the tendency of the sheet to counteract a transverse bending. This aspect is critical to avoid flexures during the assembling of the cathodic body provided with fingers with the conductive base provided with anodes that must be intercalated to the fingers, or even during operation where differential thermal expansions or turbulences of the brine induced by the ascensional motion of gaseous chlorine bubbles may occur. Considering that fingers lined with diaphragm and anodes, once intercalated, are in direct contact to each other or in any case spaced by few millimeters, any inflection of the fingers may easily cause abrasion against the anodes capable of damaging the diaphragm with consequent operation shut-down.

Figure 5:
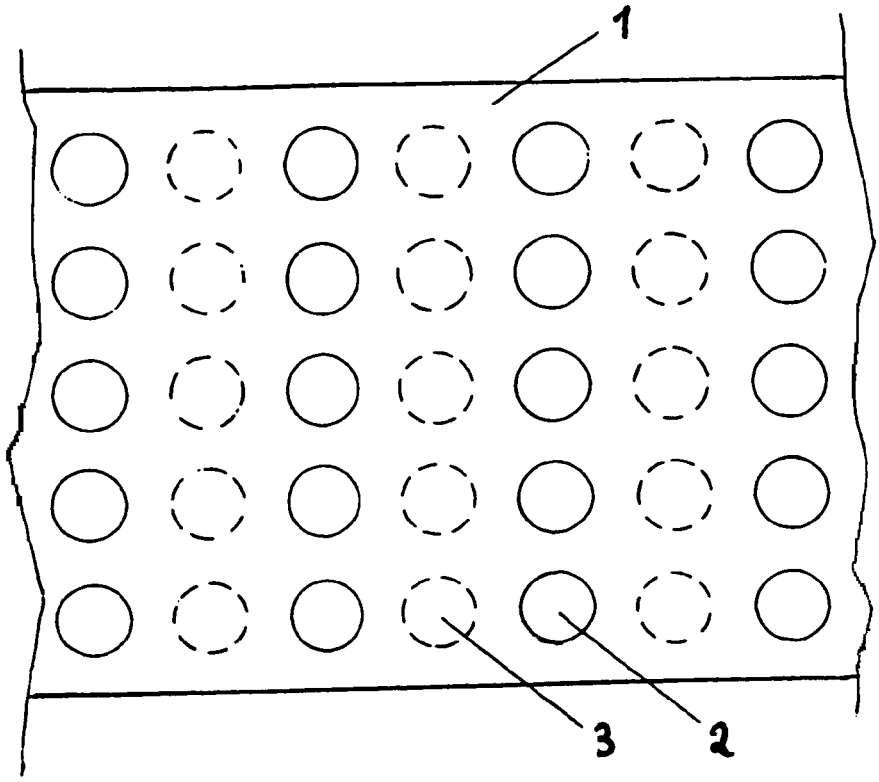
FIG. 5 illustrates a sheet with spherical cap-shaped projections arranged in a square-mesh pattern which is less preferred embodiment.

As a comparison with the quincuncial arrangement of FIG. 1, FIG. 5 shows another sheet provided with spherical cap-shaped projections according to a less preferred embodiment of the invention, with distance between centres and bending radii on the extrados and intrados as in the previous case, but arranged according to a square mesh pattern; the various elements are identified by the same reference numbers as used in FIG. 1. In the case illustrated just now, the stiffness obtained expressed in terms of bending resistance is sensibly lower than in the sheet of FIG. 1.

Figure 6:
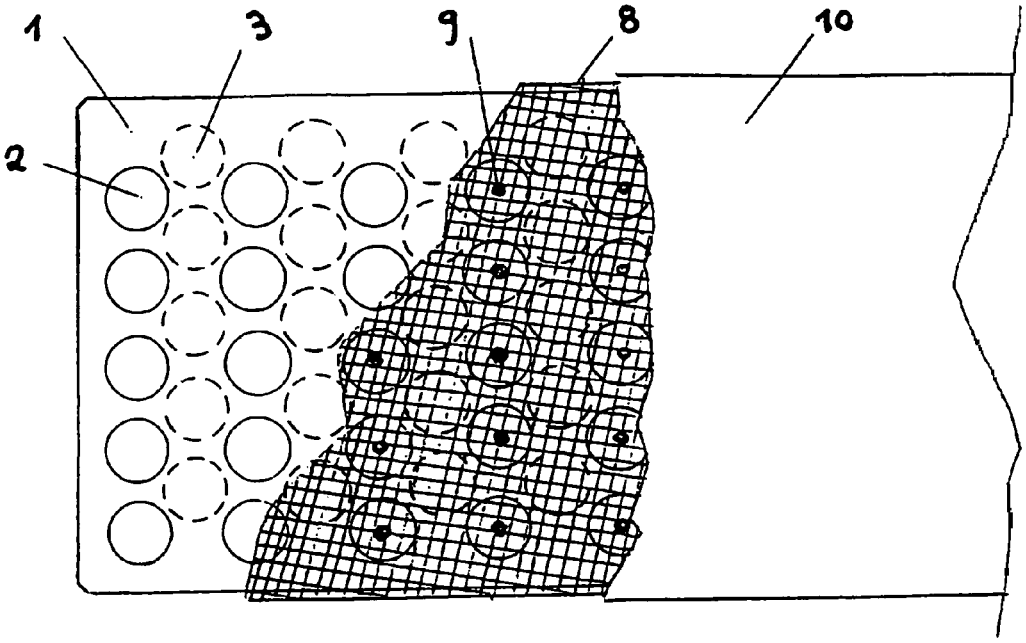
FIG. 6 is a partially cut-away side portion of a finger made of an interwoven wire mesh.

FIG. 6 shows a partially cutaway side view of a portion of the assembly according to the invention consisting of a finger made of interwoven wire mesh (8) with a sheet positioned inside (1) provided with projections (2) and (3) in the form of spherical caps arranged according to the quincuncial pattern of FIG. 1 and obtained by plastic deformation, for example by pressing. It is quite possible for each finger according to the invention to be also equipped with two superimposed sheets. The diaphragm is identified by (10).

With reference to FIG. 6, it can be immediately noticed that the surfaces of the finger consisting of interwoven wire mesh are secured onto the apex (9) of each projection, preferably by welding: being the projection arrangement repetitive, the welding process can be easily automated with considerable saving of time, manpower and manufacturing costs. The fixing of the surfaces of each finger onto the apex (9) of the projections generates a plurality of equivalent ohmic paths which are necessary to have the electric current carried by the sheet (1) distributed in a very uniform and predetermined manner to the surface of the interwoven wire mesh of each finger (8). Moreover, the fixing (9) ensures optimal support and stiffness to the finger (8)—pressed sheet (1) assembly.

Since the welding of the interwoven wire meshes or the perforated sheets gives the assembly a greater stiffness than that of the sheet alone, it is also possible to use pressed sheets provided with projections wherein completely flat vertical sections are present, as schematically shown in FIG. 5, despite the fact that this type of sheet, characterised by lower stiffness as previously discussed, does not represent a preferred embodiment of the present invention.

In a further embodiment, the sheet provided with projections on both sides may be replaced by a couple of mutually contacting sheets, each provided with projections on the surface opposite to the contact surface.

Figure 7:
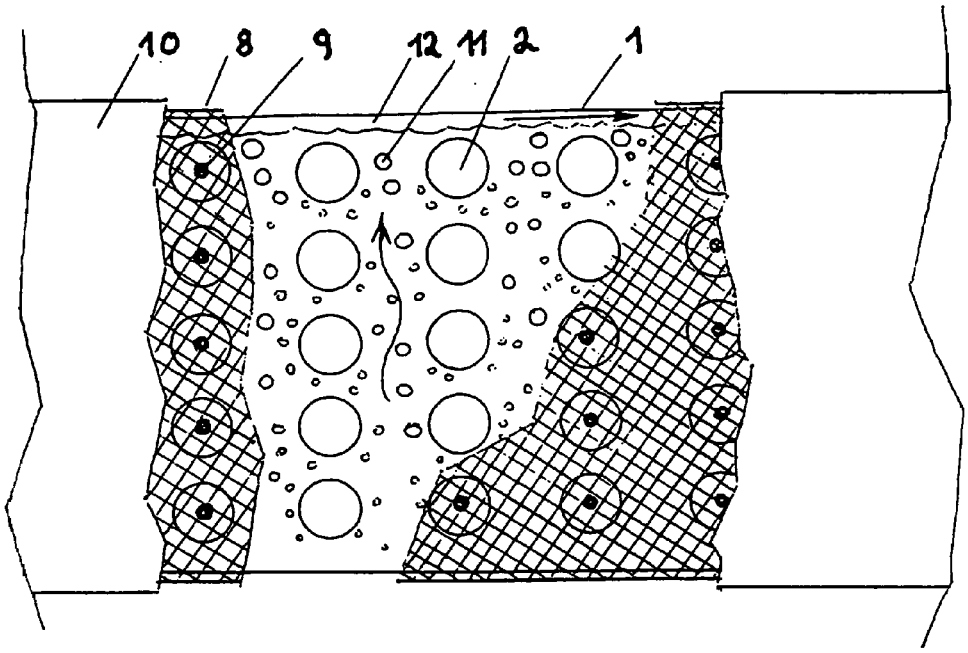
FIG. 7 is an illustration of a portion of finger-mesh pressed sheet assembly.

As FIG. 7 schematically indicates by arrows in a portion of the finger—mesh—pressed sheet assembly according to the invention, the use of the sheet provided with projections entails a free ascensional movement of the hydrogen bubbles (11) generated during operation inside each finger. As a consequence, hydrogen gathering along the finger upper generatrix (12) can freely flow towards the perimetrical chamber provided in the chlor-alkali diaphragm cells to be discharged therefrom towards the general manifold through the nozzle located on the top of the perimetrical chamber.

Figure 8:
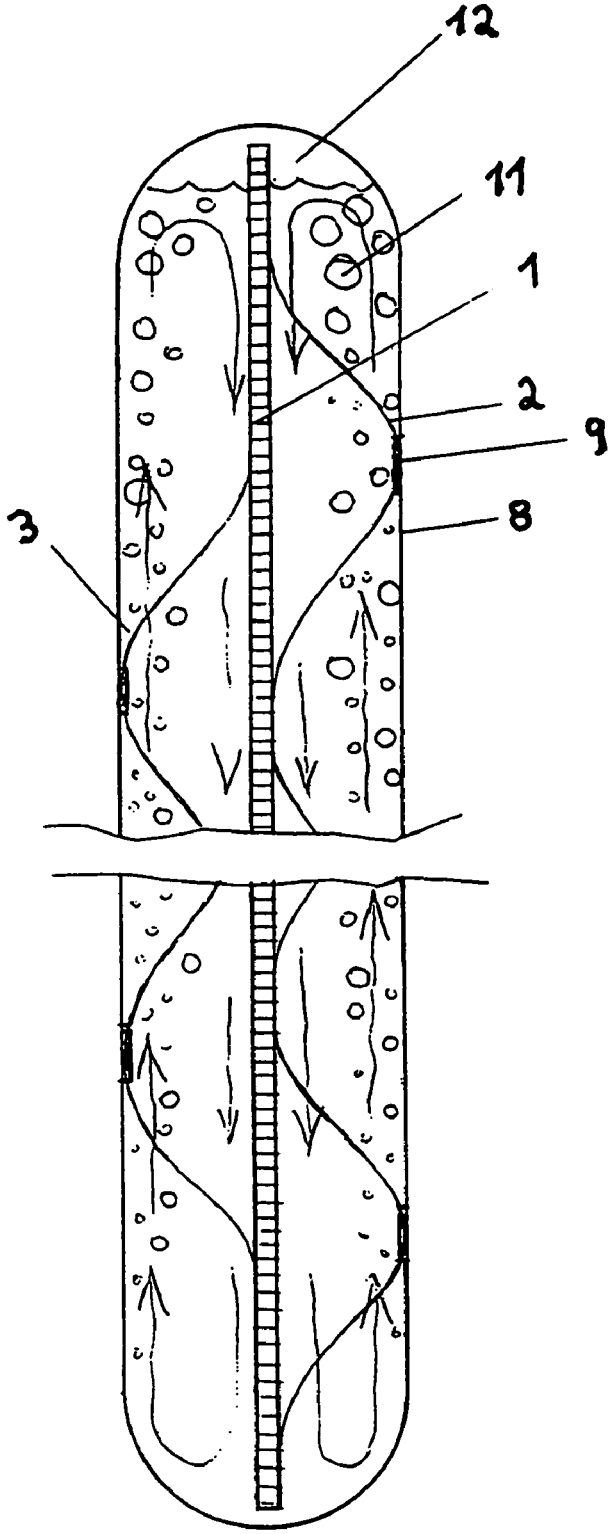
FIG. 8 schematically is a cross-section of the finger mesh assembly which illustrates the liquid flow inside the finger.

The sheet provided with projections according to the invention subdivides the internal volume of each finger into two portions and the thickness thereof is practically nearly half the thickness of the finger wherein the sheet is installed. The volume of each portion is only partially occupied by the sheet projections, and therefore the ascensional movement of the hydrogen bubbles can easily generate an effective natural recirculation of caustic soda therein. This recirculation, indicated by arrows in FIG. 8, which schematically shows a cross view of the finger—mesh assembly according to the invention, is particularly useful in that it allows to maintain a substantially uniform concentration of caustic soda inside each finger during electrolysis, even in case of inhomogeneous porosity of the diaphragms and anomalous local distribution of electric current: actually in this case, in the absence of an effective recirculation, a local increase in the caustic soda concentration would occur with a negative impact on the faradic efficiency of the process and a consequent increase of oxygen content in chlorine. As known to the experts in the art, a number of chlorine users, as for example plants producing dichloroethane and other chlorinated derivatives, require an oxygen content in chlorine not exceeding specific critical limits, over which chlorine purification through liquefaction and subsequent re-evaporation becomes necessary: therefore all those devices, such as the structure for fingers of the present invention, which installed in the cells ensure a high qualitative level of produced chlorine, offer an obvious advantage.

Though not strictly necessary, openings, not shown in the figures, can be made in correspondence to the residual flat areas of the sheets provided with projections according to the present invention: these openings are directed to favour the mixing of the caustic soda present in the two portions of volume formed inside each finger by the sheet of the present invention.

EXAMPLE

In order to allow a comparative evaluation of the validity of what disclosed in the present invention, two cells of a line of diaphragm cells of a chlor-alkali industrial plant fed with a current of 100 kA have been modified. The cells of the concerned line were provided with a cathodic body comprising fingers consisting of carbon steel interwoven wire mesh housing a 6 mm thick sheet, longitudinally corrugated as described in U.S. Pat. No. 4,138,295 and WO 00/06798: two of these cells, whose cathodic body after some years of operation showed an already worn out finger mesh, were subjected to the necessary procedures of replacement in a service site with reconstruction of the fingers by means of the same type of interwoven wire mesh previously used, but with modification of the internal sheet that was replaced in one of the two cells, hereinafter defined as cell A, by a couple of sheets provided with projections according to the present invention, and in the other cell, hereinafter defined as cell B, by the strips of perforated sheet described in U.S. Pat. No. 3,988,220. In particular the sheets according to the invention had a thickness of 6 millimeters and were provided with projections similar to spherical caps with an arrangement according to the quincuncial pattern of FIG. 1, with distance between the centres of two adjacent projections equivalent to 57.7 millimeters and with each projection characterised by radii of extrados and intrados equivalent to 20 and 14 millimeters respectively. The indicated dimensions have been chosen according to a preferred embodiment of the invention; in general, sheets having thickness between 5 and 7 millimeters are preferred, whereas it was found that the optimal distance between the projections is ranging from 50 to 65 millimeters, with radii of extrados and intrados ranging from 17 and 22 and from 12 and 16 millimeters respectively.

The strips of perforated sheet of the fingers of the cell B having thickness of 6 millimeters have been inserted into each finger in such a number as to obtain a section for the electric current passage similar to that of the couple of sheets according to the invention installed in each finger of the cell A. The openings, made on each strip on three rows, had a diameter of 8 millimeters.

No additional modification was made on the remaining parts of cells A and B, except for the obvious installation of a new set of sealing gaskets between cathodic body—anodic base, cathodic body—cover, nozzles—pipes, and a new diaphragm.

After a few weeks of operation considered necessary for the stabilisation of the different components and particularly of the diaphragms, cell voltage, faradic efficiency of caustic soda production and oxygen content in the product chlorine were determined with the following results:

- unmodified cells of the plant: voltage 3.6 volt, faradic efficiency 93%, oxygen content in chlorine 3%
- cell A according to the present invention: voltage 3.5 volt, faradic efficiency 95%, oxygen content in chlorine 2.3%
- cell B according to U.S. Pat. No. 3,988,220: voltage 3.55 volt, faradic efficiency 94%, oxygen content in chlorine 2.7%

The above description is not to be intended as limiting the invention, which can be practised according to different embodiments without departing from its scope, and whose domain is solely defined by the appended claims.

In the description and claims of the present application, the word "comprise" and variations thereof such as "comprising" and "comprises" are not intended to exclude the presence of other additional elements or components.

The invention claimed is:

1. A cathodic finger structure for diaphragm electrolytic cell, comprising a hollow body defining an internal volume in fluid communication with a perimetrical chamber and delimited by a conductive surface provided with holes coated with chemically inert porous diaphragm, said hollow body housing a reinforcing and electric current distributing internal element constituted by at least one sheet provided with projections, wherein said projections have a shape equivalent to spherical caps or elliptic caps or caps with prismatic sections.

2. The finger structure of claim 1, wherein the conductive surface provided with holes is an interwoven wire mesh or a perforated sheet.

3. The finger structure of claim 1 wherein said at least one sheet is a single sheet provided with projections on both its major surfaces.

4. The finger structure according to claim 1 wherein said sheet provided with projections is secured to said conductive surface by means of an electrically conductive connection.

5. The finger structure of claim 4, wherein said conductive connection is located on the apex of at least part of said projections.

6. The finger structure of claim 4 wherein said conductive connection establishes a plurality of generally equivalent ohmic paths for the uniform distribution of electric current.

7. The finger structure of claim 1 wherein said projections are arranged according to a square mesh pattern.

8. The finger structure of claim 1 wherein said projections are arranged according to a quincuncial pattern.

9. The finger structure of claim 1 wherein each vertical section of said at least one sheet comprises part of at least one of said projections.

10. The finger structure of claim 1 wherein the distance between the centers of two adjacent caps is between 50 and 65 millimeters and the radii of extrados and intrados of said caps are between 17 and 22 millimeters and between 12 and 16 millimeters respectively.

11. The finger structure of claim 1 wherein the thickness of said sheet is comprised between 5 and 7 millimeters.

12. The forger structure of claim 1 wherein said internal volume defined by said hollow body is subdivided by said at least one sheet into two portions in fluid communication with said perimetrical chamber, and said portions are only partially occupied by said projections and are available for the natural internal recirculation of electrolytes.

13. The finger structure of claim 1 wherein said at least one sheet provided with projections is further provided with openings in the residual flat areas.

14. The finger structure of claim 1 wherein said projections are obtained by plastic deformation of said at least one sheet.

15. The finger of claim 1 wherein said projections are independent pieces secured onto said at least one sheet.

16. The finger according to claim 15, wherein said projections are secured onto said at least one sheet by welding or brazing.

17. An electrolysis cell comprising an anodic compartment and a cathodic compartment separated by an inert porous diaphragm, wherein said cathodic compartment consists of a perimetrical chamber provided with at least one nozzle in the bottom for discharging electrolytes and with at least one nozzle in the top for gas outlet, and of a plurality of cathodic fingers according to claim 1 electrically connected to said perimetrical chamber.

18. A process of chlor-alkali electrolysis, comprising feeding a sodium chloride solution to the anodic compartment of the cell of claim 17, applying electric current and discharging a solution of caustic soda and depleted sodium chloride formed inside said internal volume of said plurality of cathodic fingers through said nozzle for discharging electrolytes and a hydrogen flow through said nozzle for gas outlet.

19. The process of claim 18 wherein said hydrogen has free ascensional motion inside the internal volume of said plurality of cathodic fingers and free longitudinal motion towards said perimetrical chamber, and in that said solution of caustic soda and depleted sodium chloride has free recirculation in the internal volume of said plurality of cathodic fingers.

20. The process of claim 19, wherein said hydrogen has free ascensional motion inside the internal volume of said plurality of cathodic fingers and free longitudinal motion towards said perimetrical chamber, and in that said solution of caustic soda and depleted sodium chloride has free recirculation in the internal volume of said plurality of cathodic fingers.

* * * * *